US009845526B2

(12) United States Patent
Stapel et al.

(10) Patent No.: US 9,845,526 B2
(45) Date of Patent: Dec. 19, 2017

(54) SLIP AND PROCESS FOR PRODUCING AN ALUMINUM DIFFUSION LAYER

(71) Applicant: MTU Aero Engines AG, Munich (DE)

(72) Inventors: Martin Stapel, Munich (DE); Natividad Lopez Lavernia, Munich (DE); Horst Pillhoefer, Roehrmoos (DE); Max Morant, Aschau (DE); Max Niegl, Munich (DE)

(73) Assignee: MTU AERO ENGINES AG, Munich (DE)

( * ) Notice: Subject to any disclaimer, the term of this patent is extended or adjusted under 35 U.S.C. 154(b) by 552 days.

(21) Appl. No.: 14/384,253

(22) PCT Filed: Mar. 27, 2013

(86) PCT No.: PCT/DE2013/000164

§ 371 (c)(1),
(2) Date: Sep. 10, 2014

(87) PCT Pub. No.: WO2013/149609

PCT Pub. Date: Oct. 10, 2013

(65) Prior Publication Data

US 2015/0079278 A1 Mar. 19, 2015

(30) Foreign Application Priority Data

Apr. 3, 2012 (DE) ..... 10 2012 006 655

(51) Int. Cl.

| | |
|---|---|
| ***C23C 10/20*** | (2006.01) |
| ***C23C 10/02*** | (2006.01) |
| ***C23C 10/18*** | (2006.01) |
| ***C23C 10/48*** | (2006.01) |
| ***C23C 10/60*** | (2006.01) |
| ***C09D 5/10*** | (2006.01) |

(52) U.S. Cl.
CPC ..... *C23C 10/20* (2013.01); *C23C 10/02* (2013.01); *C23C 10/18* (2013.01); *C23C 10/60* (2013.01)

(58) Field of Classification Search
CPC ..... C23C 10/02; C23C 10/18; C23C 10/20; C23C 10/48; C23C 10/60; C09D 5/103
USPC ..... 106/1.25, 14.12, 14.13, 14.14, 14.21, 106/14.39; 427/147, 299, 327, 380; 148/243, 248, 250, 253
See application file for complete search history.

(56) References Cited

U.S. PATENT DOCUMENTS

| | | | | |
|---|---|---|---|---|
| 4,229,495 | A * | 10/1980 | Takahashi | C09D 5/10 106/14.21 |
| 4,500,364 | A * | 2/1985 | Krutenat | C23C 24/10 148/242 |
| 5,547,770 | A | 8/1996 | Meelu et al. | |
| 5,650,235 | A * | 7/1997 | McMordie | C23C 10/26 428/610 |
| 5,795,659 | A * | 8/1998 | Meelu | C23C 10/28 416/241 R |
| 6,036,995 | A | 3/2000 | Kirchner et al. | |
| 6,379,804 | B1 * | 4/2002 | Ackerman | B22F 1/0055 428/210 |
| 7,270,852 | B2 | 9/2007 | Kool et al. | |
| 7,597,934 | B2 * | 10/2009 | Nagaraj | C23C 10/60 427/383.1 |
| 7,896,962 | B2 | 3/2011 | Kool et al. | |
| 2005/0031781 | A1 | 2/2005 | Kool et al. | |
| 2005/0031877 | A1 * | 2/2005 | Gigliotti, Jr. | C23C 10/30 428/457 |
| 2006/0204666 | A1 * | 9/2006 | Buczek | C09D 5/103 427/421.1 |
| 2007/0287013 | A1 | 12/2007 | Kool et al. | |
| 2007/0298269 | A1 * | 12/2007 | Kool | C23C 10/18 428/457 |
| 2009/0126833 | A1 | 5/2009 | Cavanaugh et al. | |
| 2009/0169750 | A1 * | 7/2009 | Wilkins | C23C 10/02 427/287 |
| 2016/0122555 | A1 * | 5/2016 | Lopez Lavernia | C09D 5/103 106/14.21 |

FOREIGN PATENT DOCUMENTS

| | | | |
|---|---|---|---|
| EP | 1505176 | A1 | 2/2005 |
| EP | 2014785 | A1 | 1/2009 |
| EP | 2060653 | A2 | 5/2009 |
| WO | 9323247 | A1 | 11/1993 |
| WO | 2010134918 | A1 | 11/2010 |

* cited by examiner

*Primary Examiner* — Helene Klemanski
(74) *Attorney, Agent, or Firm* — Abel Law Group, LLP

(57) ABSTRACT

The present invention relates to a slip for producing an aluminum diffusion layer which comprises an Al-containing powder and an Si-containing powder and a binder, the slurry further comprising an Al-containing powder the powder particles of which are coated with Si. The invention further relates to a process for producing an aluminum diffusion layer, comprising the following steps: providing a slurry according to any one of the preceding claims, applying the slurry to a component surface on which the aluminum diffusion layer is to be created, drying and/or curing by way of a heat treatment at a first temperature, and diffusion annealing at a second temperature.

20 Claims, No Drawings

SLIP AND PROCESS FOR PRODUCING AN ALUMINUM DIFFUSION LAYER

BACKGROUND TO THE INVENTION

Field of the Invention

The present invention relates to a slip and a process for producing an aluminum diffusion layer.

Discussion of Background Information

In metallic components which are exposed to high temperatures, for example components of flow machines in the form of stationary gas turbines or aircraft engines, the metallic surfaces have to be protected from oxidative and/or corrosive attack. For this purpose, many different layer systems are known in the prior art.

Layer systems used also include, inter alia, diffusion layers in which chemical elements diffuse into the metallic surface to be protected and/or deposit on the surface in order to achieve an accumulation of the corresponding elements at the surface to be protected. The element which has diffused in then provides, together with the alloy constituents of the base material, appropriate properties in order to be able to operate the component at the desired high temperatures.

Thus, for example, the provision of aluminum diffusion layers on high-temperature materials, e.g. iron-, cobalt- or nickel-based alloys, is known, with the accumulation of aluminum in the surface region of the corresponding alloys leading to a slowly growing aluminum oxide layer being formed when high-temperature oxidative attack occurs and protecting the material against further damaging oxidative attack.

Such an aluminum diffusion layer can be produced, inter alia, by application of a slip comprising aluminum-containing powder particles which provide the aluminum for the diffusion process, where, after drying and/or hardening of the slip on the surface to be treated, the aluminum diffuses into the material from the dry slip layer during subsequent diffusion heat treatment. The application of such a slip by painting, dipping or spraying is very simple, so that a process of this type is of industrial interest for producing an aluminum diffusion layer. In particular, components can also be repaired in a simple way by the simple application.

Known slips for carrying out an aluminum diffusion process comprise, in addition to aluminum-containing powder particles, a binder which essentially provides the liquid phase for forming the slip. However, such a slip also has to be of such a nature that the aluminum-containing powder is preferably not oxidized by the binder, so that the subsequent diffusion process is not made difficult by the presence of aluminum oxide. Accordingly, provision of additional oxides such as silicon dioxide or else chromates, dichromates or phosphates in the aqueous and acidic binders is known. Chromates in particular have been used in the past in order to increase the corrosion resistance of the correspondingly treated metal component and also to inhibit oxidation of the metallic aluminum in the slip. However, chromium(VI) compounds are extremely toxic and hazardous to health, so that attempts are increasingly being made to replace these components in the slip compositions. Examples are described in EP 2 060 653 A2, U.S. Pat. No. 7,896,962 B2, WO 2010/134918 A1, U.S. Pat. No. 7,270,852 B2, U.S. Pat. No. 6,036,995 or WO 93/023247 A1.

In particular, attempts are made to produce stable slips for the production of aluminum diffusion layers which make do without toxic Cr(VI) compounds which are hazardous to health by the addition of silicon dioxide and the use of silicon-aluminum alloys as particle constituents in a slip and also the use of glycols as organic binders. Here, in particular, a passivating function for the metallic aluminum constituents is ascribed to the silicon as alloy constituent of the aluminum-containing powder and as additive in the form of silicon dioxide.

Although good results have already been achieved in this way, the problem that such slips do not have the required stability which enables the slip to be stored and processed over a prolonged period of time without decreases in the effectiveness of the slip during a subsequent diffusion heat treatment being observed remains.

DISCLOSURE OF THE INVENTION

Object of the Invention

It is therefore an object of the present invention to provide a slip for producing an aluminum diffusion layer and also a process for producing an aluminum diffusion layer, in which good stability of the slip composition combined with high effectiveness of the slip composition in respect of the provision of aluminum in the diffusion treatment is ensured. In addition, the slip should be simple to produce and use.

Technical Solution

This object is achieved by a slip and also a process for producing an aluminum diffusion layer having the features as recited in the instant independent claims. Advantageous embodiments are provided in the dependent claims.

The invention proposes providing a slip in which the stability of the slip composition and in particular the metallic aluminum components is increased by the aluminum-containing powder used in the slip for providing the aluminum at least partly comprising powder particles which are coated with silicon. The proportion of the silicon-coated powder particles can range from small proportions in the single-digit percentage range of the amount of aluminum particles up to 100% of the aluminum particles. In particular, the proportion of the silicon-coated aluminum particles as a percentage of the total number of aluminum particles can be selected in the range from 25% to 75%, preferably from 40% to 60%, with the percentages being able to be either by weight or by volume.

The silicon-coated aluminum-containing powder particles can, in respect of the aluminum core, be pure aluminum particles in the sense of technical-grade aluminum or aluminum alloy particles. The silicon-coated aluminum powder particles can, in respect of the aluminum core, be identical to the further, aluminum-containing powder particles of the slip composition or differ from these in terms of size, shape and composition.

Apart from the silicon-coated aluminum-containing powder particles and/or the uncoated aluminum-containing powder particles, the slip further comprises silicon-containing powder particles and a binder.

The silicon-containing powder particles can once again be formed by technical-grade silicon powder particles or powder particles composed of silicon alloys. In particular, they can be composed of silicon alloys which have more than 50% by weight of silicon in the alloy composition or at least have silicon as component present in the greatest proportion.

The silicon-coated aluminum-containing powder particles can likewise be coated with technical-grade silicon or with appropriate silicon alloys.

The binder can comprise one or more components from the group which comprises organic substances, water, alcohols, glycol compounds, phosphates or phosphate-containing substances and thickeners.

In an advantageous embodiment, the binder can comprise water, at least one glycol compound and at least one thickener.

The thickener of the binder can comprise one or more components from the group which comprises pectins, guar, carob seed flour, carrageenan, cellulose ethers, polyvinyl alcohol and silicates.

In particular, the binder can comprise glycol ether acetate in an amount of from 90% by weight to 100% by weight and thickeners in an amount of from 1% by weight to 2% by weight.

The total slip can then comprise glycol ether acetate in an amount of from 40% by weight to 50% by weight, thickeners in an amount of from 0.5% by weight to 1% by weight, coated and/or uncoated aluminum powder in an amount of from 30% by weight to 40% by weight and silicon powder in an amount of from 6% by weight to 7% by weight.

According to a further aspect of the present invention, for which protection is sought independently and in combination with other aspects of the invention, a process for producing an aluminum diffusion layer, in which a slip as described above is used, is proposed. The corresponding slip is, for example, applied to the component area on which the aluminum diffusion layer is to be produced by brushing, dipping of the corresponding component into the slip or by spraying of the slip. The component area provided in this way with slip is subjected to a heat treatment at a first temperature in order to dry and/or cure the slip. This is followed by diffusion heat treatment to form the diffusion layer at a second temperature which is higher than the first temperature.

The first temperature can, for example, be selected in the range from 100° C. to 300° C., preferably from 120° C. to 220° C., while the second temperature can be selected in the range from 800° C. to 1000° C., preferably from 875° C. to 925° C.

Before application of the slip to the component surface to be treated, the latter can be blasted with particles in order to obtain a metallic and clean surface, in particular using aluminum oxide particles.

EXAMPLE

A chromium(VI)-free slip composition which can be used, in particular, for the repair of high-temperature-stressed components of aircraft engines, for example turbine blades, comprises an aluminum powder and also an aluminum powder with aluminum particles which are coated with silicon. The proportions of uncoated aluminum powder and of aluminum powder particles which are coated with silicon can, for example, be in a ratio of (0 to 1):1. The aluminum powders together with a silicon powder are taken up in a binder which consists of water, a glycol compound and a thickener.

A further example of a slip comprises from 40% by weight to 50% by weight of glycol ether acetate, from 0.5% by weight to 1% by weight of thickener, from 30% by weight to 40% by weight of coated and uncoated aluminum powder and from 6% by weight to 7% by weight of silicon powder. Correspondingly, the binder can comprise from 90% by weight to 100% by weight of glycol ether acetate and from 1% by weight to 2% by weight of thickener.

Such a slip is sprayed or brushed onto a surface which has been blasted with aluminum oxide particles and heated at about 150° C. to effect drying and/or curing until the binder has been dried and/or cured. If further layers of slip are applied, drying at about 80° C. after application of each layer can be useful. A diffusion heat treatment under a protective gas atmosphere, for example an argon atmosphere, at 900° C. is then carried out for some hours so as to form an aluminum diffusion layer which offers the component oxidation protection for high temperature applications on the component surface.

Although the present invention has been described in detail for the example, the invention is not restricted to this example but can comprise modifications, for example the omission of individual features or the combination of different features, as long as the scope of protection of the attached claims is not left. The present disclosure comprises all combinations of all individual features presented.

What is claimed is:

1. A slurry for producing an aluminum diffusion layer, wherein the slurry comprises Al-containing powder, Si-containing powder, and a binder, the Al-containing powder comprising uncoated powder particles and powder particles which are coated with Si.

2. The slurry of claim 1, wherein the Al-containing powder comprises technical-grade aluminum or Al alloys and/or the Si-containing powder comprises technical-grade silicon or Si alloys.

3. The slurry of claim 1, wherein a proportion of silicon-coated aluminum powder particles as a percentage of a total number of aluminum powder particles is from 25% to 75% by weight or by volume.

4. The slurry of claim 1, wherein the binder comprises at least one substance from the group of water, alcohols, glycol compounds, phosphates, phosphate-containing substances, and thickeners.

5. The slurry of claim 1, wherein the binder comprises water, at least one glycol compound and at least one thickener.

6. The slurry of claim 1, wherein the binder comprises a thickener which comprises one or more substances from the group of pectins, guar, carob seed flour, carrageenan, cellulose ethers, polyvinyl alcohol, and silicates.

7. A slurry for producing an aluminum diffusion layer, wherein the slurry comprises Al-containing powder, Si-containing powder, and a binder comprising water, at least one glycol compound and at least one thickener, the Al-containing powder comprising powder particles which are coated with Si.

8. The slurry of claim 7, wherein a proportion of silicon-coated aluminum powder particles as a percentage of a total number of aluminum powder particles is from 25% to 75% by weight or by volume.

9. The slurry of claim 7, wherein the binder comprises a thickener which comprises one or more substances from the group of pectins, guar, carob seed flour, carrageenan, cellulose ethers, polyvinyl alcohol, and silicates.

10. A process for producing an aluminum diffusion layer, wherein the process comprises applying a slurry to a component area on which the aluminum diffusion layer is to be produced, drying and/or curing the applied slurry with a heat treatment at a first temperature, followed by a diffusion heat treatment at a second temperature, and wherein the slurry comprises Al-containing powder, Si-containing powder, and a binder, the Al-containing powder comprising powder particles which are coated with Si.

11. The process of claim 10, wherein the process further comprises blasting a surface to be treated with particles prior to application of the slurry.

12. The process of claim 11, wherein the particles are aluminum oxide particles.

13. The process of claim 10, wherein the first temperature is within a range from 100° C. to 300° C.

14. The process of claim 10, wherein the first temperature is within a range from 120° C. to 220° C.

15. The process of claim 10, wherein the second temperature is within a range from 800° C. to 1000° C.

16. The process of claim 10, wherein the second temperature is within a range from 875° C. to 925° C.

17. The process of claim 14, wherein the second temperature is within a range from 875° C. to 925° C.

18. The process of claim 10, wherein the component on which the aluminum diffusion layer is to be produced is a component of a gas turbine or an aircraft engine.

19. The process of claim 18, wherein the process involves repairing a gas turbine or an aircraft engine.

20. A process for producing an aluminum diffusion layer, wherein the process comprises applying the slurry of claim 1 to a component area on which the aluminum diffusion layer is to be produced, drying and/or curing the applied slurry with a heat treatment at a first temperature, followed by a diffusion heat treatment at a second temperature.

* * * * *